US008099010B2

(12) United States Patent
Miyahara

(10) Patent No.: US 8,099,010 B2
(45) Date of Patent: Jan. 17, 2012

(54) IMAGE FORMING APPARATUS WITH CONTROLLED DEVELOPING BIAS

(75) Inventor: Kensuke Miyahara, Hekinan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 346 days.

(21) Appl. No.: 12/410,958

(22) Filed: Mar. 25, 2009

(65) Prior Publication Data

US 2009/0297183 A1 Dec. 3, 2009

(30) Foreign Application Priority Data

May 29, 2008 (JP) ..... 2008-141413

(51) Int. Cl.
*G03G 15/01* (2006.01)

(52) U.S. Cl. ..... 399/82; 399/44; 399/45; 399/55; 399/66

(58) Field of Classification Search ..... 399/55, 399/53, 66, 82, 44, 45, 46, 299
See application file for complete search history.

(56) References Cited

U.S. PATENT DOCUMENTS 5,678,150 A * 10/1997 Takahashi et al. ..... 399/299
5,974,278 A * 10/1999 Nakazawa ..... 399/55
2002/0018659 A1 2/2002 Tomizawa et al.
2003/0086716 A1 5/2003 Tomizawa et al.
2005/0069352 A1* 3/2005 Nishiwaki ..... 399/299
2008/0240761 A1* 10/2008 Murrell et al. ..... 399/66

FOREIGN PATENT DOCUMENTS

JP 02-056565 A 2/1990
JP 2000-194201 A 7/2000
JP 2003-173053 6/2003
JP 2003-173053 A * 6/2003

OTHER PUBLICATIONS

JP Office Action dtd Sep. 21, 2010, JP Appln. 2008-141413, partial English Translation.

* cited by examiner

*Primary Examiner* — Sophia S Chen
(74) *Attorney, Agent, or Firm* — Banner & Witcoff, Ltd.

(57) ABSTRACT

An image forming apparatus includes a transfer bias set up section and a developing bias set up section. The transfer bias set up section sets a transfer bias applied to each transfer member so that the transfer bias applied to a transfer member corresponding to a photosensitive member on the most downstream side is greater than a transfer bias applied to a transfer member other than this transfer member. The developing bias set up section sets a developing bias applied to each developing member to a first developing bias in a single-side printing mode, and sets up the developing bias applied to each developing member in formation of an image on a first surface and in formation of another image on a second surface to a second developing bias lower than the first developing bias when the image formed on the second surface is a color image.

18 Claims, 5 Drawing Sheets

| | THIN SHEET | PLAIN SHEET | THICK SHEET |
|---|---|---|---|
| DEVELOPING BIAS REDUCTION RATIO | 0.1 | 0.05 | 0 |

29

| | | TEMPERATURE ( °C ) | | | |
|---|---|---|---|---|---|
| | | ~10 | ~20 | ~30 | ~40 |
| RELATIVE HUMIDITY (%) | ~20 | a | a | a | b |
| | ~40 | b | b | b | c |
| | ~60 | b | c | c | c |
| | ~80 | c | c | d | d |
| | ~100 | d | d | d | d |

FIG. 6A

| | FIRST SURFACE | | | |
|---|---|---|---|---|
| | a | b | c | d |
| THIN SHEET | 2 | 2 | 2 | 2 |
| PLAIN SHEET | 3 | 3 | 4 | 4 |
| THICK SHEET | 5 | 5 | 6 | 6 |

31A

FIG. 6B

| | FIRST SURFACE | | | | SECOND SURFACE | | | |
|---|---|---|---|---|---|---|---|---|
| | a | b | c | d | a | b | c | d |
| THIN SHEET | 2 | 2 | 2 | 2 | 3 | 3 | 2 | 2 |
| PLAIN SHEET | 3 | 3 | 4 | 4 | 4 | 3 | 2 | 2 |
| THICK SHEET | 5 | 5 | 6 | 6 | 3 | 3 | 4 | 4 |

31B

FIG. 6C

| | FIRST SURFACE | | | | SECOND SURFACE | | | |
|---|---|---|---|---|---|---|---|---|
| | a | b | c | d | a | b | c | d |
| THIN SHEET | 1 | 1 | 1 | 1 | 3 | 3 | 2 | 2 |
| PLAIN SHEET | 2 | 2 | 3 | 3 | 4 | 3 | 2 | 2 |
| THICK SHEET | 4 | 4 | 5 | 5 | 3 | 3 | 4 | 4 |

31C

FIG. 7

| | K | Y | M | C |
|---|---|---|---|---|
| 1 | 8 | 9 | 10 | 11 |
| 2 | 9 | 10 | 11 | 12 |
| 3 | 10 | 11 | 12 | 13 |
| 4 | 11 | 12 | 13 | 14 |
| 5 | 12 | 13 | 14 | 15 |
| 6 | 13 | 14 | 15 | 16 |

32 (μA)

IMAGE FORMING APPARATUS WITH CONTROLLED DEVELOPING BIAS

CROSS REFERENCE TO RELATED APPLICATION

This application claims priority to Japanese Patent Application No. 2008-141413 filed on May 29, 2008, the disclosure of which is hereby incorporated into the present application.

TECHNICAL FIELD

The present invention relates to an image forming apparatus such as a color printer.

BACKGROUND

The so-called tandem type image forming apparatus having photosensitive drums corresponding to yellow, magenta, cyan and black respectively arranged in line in a transport direction for sheets is known in relation to an image forming apparatus such as a color printer.

In the tandem type image forming apparatus, a developing roller and a transfer roller are provided correspondingly to each photosensitive drum. A developing bias for forming potential difference between the developing roller and the photosensitive drum is applied to the developing roller. A transfer bias for forming potential difference between the transfer roller and the photosensitive drum is applied to the transfer roller.

In image formation, an electrostatic latent image responsive to an image to be formed on each sheet is formed on the photosensitive drum. When the electrostatic latent image is opposed to the developing roller upon rotation of the photosensitive drum, a toner is fed from the developing roller to the electrostatic latent image due to the potential difference between the photosensitive drum and the developing roller. Thus, the electrostatic latent image is developed into a toner image, and this toner image is carried on the photosensitive drum. The transfer roller is arranged on a position opposed to the photosensitive drum through a transport passage for the sheet. When the toner image carried on the photosensitive drum is opposed to the transfer roller through the sheet upon rotation of the photosensitive drum and transportation of the sheet, the toner image is transferred from the photosensitive drum to the sheet due to the potential difference between the photosensitive drum and the sheet. In formation of a color image on the sheet, toner images carried on the photosensitive drums are transferred to the same position of the sheet. The color toner images overlapped on the sheet are fixed to the sheet as a color image by heating and pressurization.

In relation to such tandem type image forming apparatus, there are image forming apparatuses having a single-side printing mode of forming an image on a single surface of the sheet and a double-side printing mode of forming images on both surfaces of the sheet. In the double-side printing mode, an image is formed on a first surface of the sheet, the sheet is thereafter transported in a reversed manner, and another image is formed on a second surface of the sheet opposite to the first surface.

The toner constituting the toner image formed on the sheet is charged in the same polarity as the surface of the photosensitive drum. Therefore, the charge quantity of the toner on the sheet is increased (the toner is charged up) every time the sheet is opposed to the photosensitive drum. Consequently, the surface potential (the charge quantity) of the sheet transported while being successively opposed to the photosensitive drums is increased along with the progress of the transportation. Particularly in the double-side printing mode, the sheet is dried due to the heating for fixing the toner image in formation of the image on the first surface of the sheet, and the electrical resistance of the sheet is increased following this. In formation of the image on the second surface of the sheet, therefore, the surface potential of the sheet is remarkably increased and a leakage of transfer current (electricity fed to the transfer roller) to a portion of the surface of the photosensitive drum not in contact with the sheet is increased as the transportation of the sheet progresses. When the surface potential of the sheet is increased, the potential difference formed between the photosensitive drum and the sheet is reduced, and hence the transfer efficiency of the toner from the photosensitive drum to the sheet is reduced. Consequently, the quality of the color image formed on the sheet is reduced.

In order to prevent this, the transfer bias applied to each transfer roller may conceivably be set up in consideration of the increase in the potential of the sheet. In this case, the transfer bias applied to the transfer roller on the most downstream side in the transport direction for the sheet is set up to the greatest value among the transfer biases applied to the four transfer rollers. In the double-side printing mode, further, the transfer bias applied to each transfer roller in formation of the image on the second surface of the sheet is set up to a value greater than the transfer bias applied to each transfer roller in formation of the image on the first surface of the sheet.

According to this technique, however, the potential difference between the transfer roller on the most downstream side in the transport direction for the sheet and the sheet may be excessively increased to cause discharge between the transfer roller and the sheet in formation of the image on the second surface of the sheet.

SUMMARY

One aspect of the present invention may provide an image forming apparatus capable of excellently transferring a developer image from a photosensitive member to a recording medium while preventing discharge between a transfer member and the recording medium.

The same or different aspect of the present invention may provide an image forming apparatus having a single-side printing mode of forming an image on a single surface of a recording medium and a double-side printing mode of forming an image on a first surface of the recording medium and thereafter forming another image on a second surface of the recording medium opposite to the first surface. The image forming apparatus includes: a plurality of photosensitive members arranged in line in a transport direction for the recording medium so that electrostatic latent images are formed thereon; a developing member provided correspondingly to each photosensitive member and supplied with a developing bias for forming potential difference between the same and the corresponding photosensitive member, for feeding a developer of a prescribed color to the photosensitive member and developing the electrostatic latent image formed on the photosensitive member into a developer image; a transfer member provided correspondingly to each photosensitive member and supplied with a transfer bias for forming potential difference between the same and the corresponding photosensitive member, for transferring the developer image on the photosensitive member to the recording medium; a transfer bias set up section setting up the transfer bias applied to each transfer member so that the transfer bias applied to the transfer member corresponding to the photosensitive member on the most downstream side in the transport direction is greater than the transfer bias applied to the transfer member other than this transfer member; and a developing bias set up section setting up the developing bias applied to each developing member to a first developing bias in the single-side printing mode while setting up the developing bias applied to each developing member in formation of the image on the first surface and in formation of the image on the second surface to a second developing bias lower than the first developing bias when the image formed on the second surface is an image formed by overlapping developer images of a plurality of colors in the double-side printing mode.

BRIEF DESCRIPTION OF THE DRAWINGS

FIG. 6A is a diagram showing an example of a selection table retained in the microcomputer shown in FIG. 2 and used in a single-side printing mode.

FIG. 6B is a diagram showing an example of a selection table retained in the microcomputer shown in FIG. 2 and used when an image formed on a second surface of a sheet is a monochromatic image.

FIG. 6C is a diagram showing an example of a selection table retained in the microcomputer shown in FIG. 2 and used when the image formed on the second surface of the sheet is an image formed by overlapping toner images of a plurality of colors.

FIG. 7 is a diagram showing an example of a transfer current table retained in the microcomputer shown in FIG. 2.

DETAILED DESCRIPTION

An embodiment of the present invention is now described with reference to the drawings.

A. Overall Structure of Printer

Figure 1:
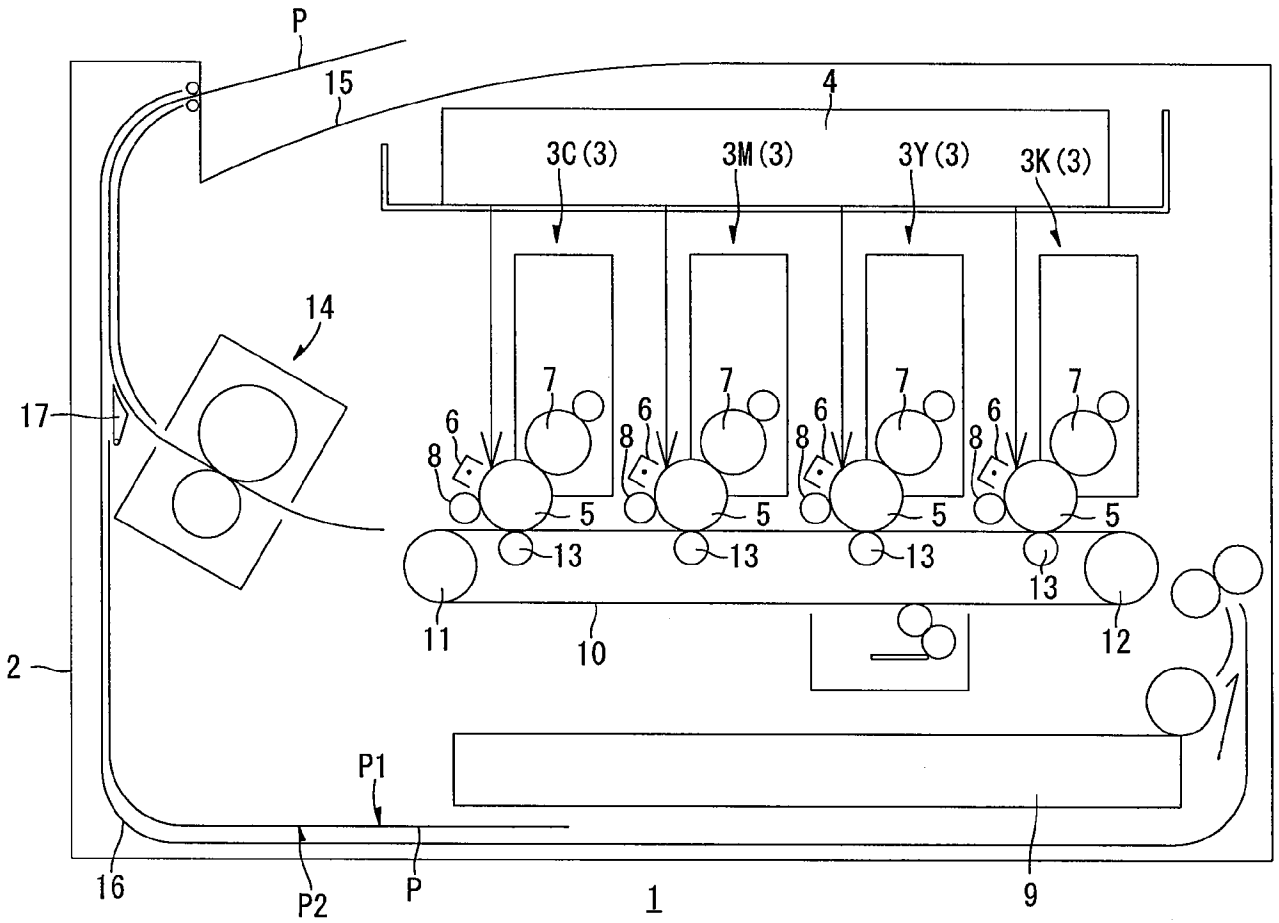
FIG. 1 is a side sectional view of a color printer according to an embodiment of the present invention.

FIG. 1 is a side sectional view of a color printer according to an embodiment of the present invention.

A color printer 1 as an example of an image forming apparatus is a tandem type color printer. Four processing sections 3 are parallelly arranged in a main body casing 2. The processing sections 3 are provided correspondingly to black, yellow, magenta and cyan respectively, and arranged in the order of black, yellow, magenta and cyan in a transport direction for a sheet P as an example of a recording medium by a transport belt 10 described later. An exposure unit 4 emitting four laser beams corresponding to the respective colors is arranged above the processing sections 3.

Each processing section 3 includes a photosensitive drum 5 as an example of a photosensitive member, a scorotron charger 6, a developing roller 7 as an example of a developing member and a cleaning roller 8. Following rotation of the photosensitive drum 5, the surface of the photosensitive drum 5 is uniformly charged by the scorotron charger 6, and thereafter selectively exposed by the corresponding laser beam from the exposure unit 4. Due to this exposure, charge is selectively removed from the surface of the photosensitive drum 5 and an electrostatic latent image is formed on the surface of the photosensitive drum 5. A developing bias is applied to the developing roller 7. When the electrostatic image is opposed to the developing roller 7, a toner is fed from the developing roller 7 to the electrostatic latent image due to the potential difference between the electrostatic image and the developing roller 7. Thus, a toner image is formed on the surface of the photosensitive drum 5.

In place of the exposure unit 4, four LED arrays may be provided correspondingly to the processing sections 3 respectively.

A sheet feeding cassette 9 accommodating sheets P is arranged on the bottom portion of the main body casing 2. Each sheet P accommodated in the sheet feeding cassette 9 is transported onto the transport belt 10 by various rollers. The transport belt 10 is extended between a pair of a driving roller 11 and a driven roller 12, and opposed to the four photosensitive drums 5 from below. A transfer roller 13 as an example of a transfer member is arranged on each position opposed to each photosensitive drum 5 through an upper portion of the transport belt 10. A transfer bias is applied to the transfer roller 13. The sheet P transported onto the transport belt 10 successively passes through between the transport belt 10 and the photosensitive drums 5. When opposed to the sheet P, the toner image on the surface of each photosensitive drum 5 is transferred to the sheet P due to the potential difference between the photosensitive drum 5 and the transfer roller 13.

A fixing section 14 is provided on the downstream side of the transport belt 10 in the transport direction for the sheet P. The sheet P having the toner image transferred thereto is transported to the fixing section 14. In the fixing section 14, the toner image is fixed to the sheet P as an image by heating and pressurization. The sheet P having the image formed in this manner is ejected to a sheet ejection tray 15 provided on the upper surface of the main body casing 2 by various rollers.

The color printer 1 has a single-side printing mode of forming an image on a single surface of the sheet P and a double-side printing mode of forming an image on a first surface P1 of the sheet P and thereafter forming another image on a second surface P2 of the sheet P opposite to the first surface P1 as operation modes.

The color printer 1 includes a reversal transport path 16 and a flapper 17 as structures for implementing the double-side printing mode. The reversal transport path 16 has an end connected to a transport passage reaching the transport belt 10 from the sheet feeding cassette 9 and another end connected to a transport passage reaching the sheet ejection tray 15 from the fixing section 14. The flapper 17 is enabled to open/close the transport passage reaching the sheet ejection tray 15 from the fixing section 14, and urged in a direction for closing the transport passage in general.

In the double-side printing mode, the image is first formed on the first surface P1 of the sheet P. The sheet P having the image formed on the first surface P1 is transported through the transport passage reaching the sheet ejection tray 15 from the fixing section 14 while pressing the flapper 17 in a direction for opening the transport passage. When the sheet P separates from the flapper 17, the transport direction for the sheet P is reversed. Thus, the sheet P is transported through the reversal transport path 16 onto the transport belt 10 while directing the second surface P2 downward. Formation of the images on both surfaces of the sheet P is achieved by forming the image on the second surface P2 of the sheet P.

Referring to FIG. 1, symbols K (black), Y (yellow), M (magenta) and C (cyan) denoting the respective colors are assigned to the reference numerals of the process portions 3 respectively.

B. Electrical Structure of Color Printer

Figure 2:
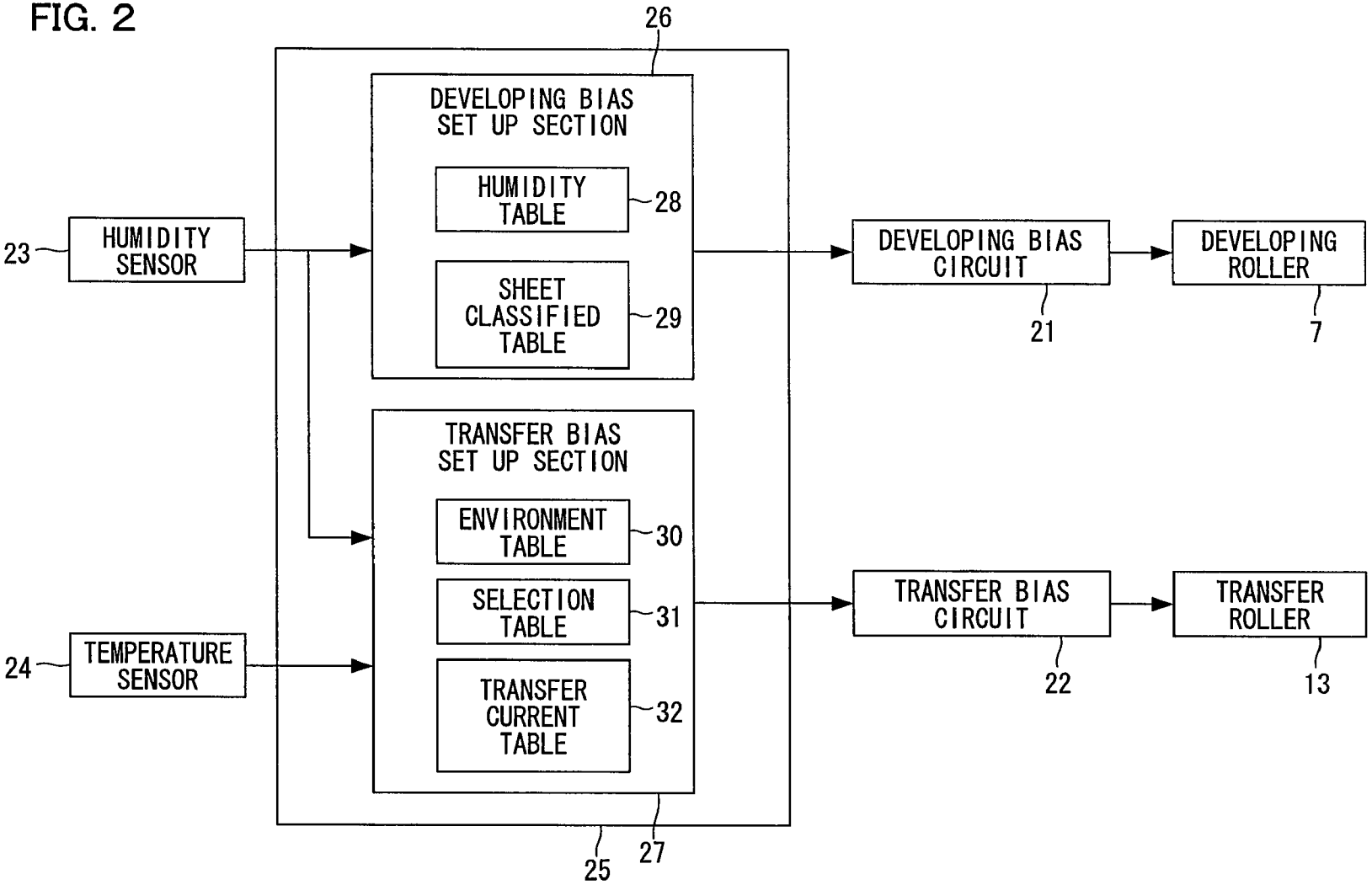
FIG. 2 is a block diagram showing an electrical structure of the color printer.

FIG. 2 is a block diagram showing the electrical structure of the color printer.

The color printer 1 includes a developing bias circuit 21 applying the developing bias to the developing roller 7, a transfer bias circuit 22 applying the transfer bias to the transfer roller 13, a humidity sensor 23 as an example of a humidity sensing portion sensing the relative humidity in the main body casing 2 and a temperature sensor 24 sensing the temperature in the main body casing 2.

The color printer 1 further includes a microcomputer 25 for setting up the developing bias applied from the developing bias circuit 21 to the developing roller 7 and the transfer bias applied from the transfer bias circuit 22 to the transfer roller 13 on the basis of the relative humidity sensed by the humidity sensor 23 and the temperature sensed by the temperature sensor 24.

The microcomputer 25 includes a CPU and a memory as hardware structures. The microcomputer 25 generally includes a developing bias set up section 26 and a transfer bias set up section 27 as structures implemented in a software manner by programs run by the CPU.

The developing bias set up section 26 sets up the developing bias on the basis of the operation mode of the color printer 1, the humidity sensed by the humidity sensor 23 and the type of the sheet P according to a humidity table 28 and a sheet classified table 29 stored in the memory.

The transfer bias set up section 27 sets up the transfer bias on the basis of the humidity sensed by the humidity sensor 23 and the type of the sheet P according to an environment table 30, a selection table 31 and a transfer electricity table 32 stored in the memory.

C. Various Tables

C-1. Humidity Table

Figures 3, 4, 5:
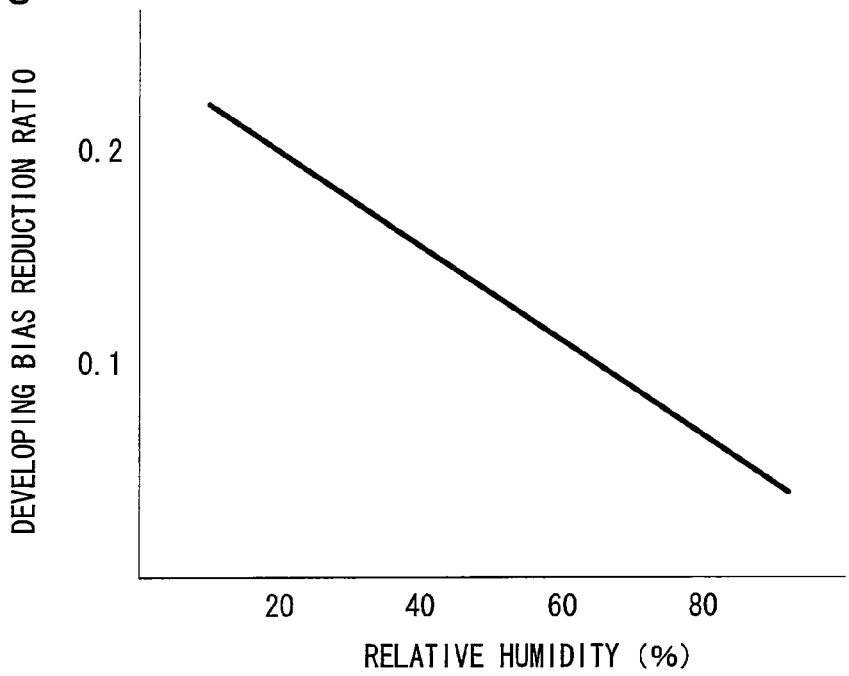
FIG. 3 is a graph showing examples of the contents of a humidity table retained in a microcomputer shown in FIG. 2.
FIG. 4 is a diagram showing an example of a sheet classified table retained in the microcomputer shown in FIG. 2.
FIG. 5 is a diagram showing an example of an environment table retained in the microcomputer shown in FIG. 2.

FIG. 3 is a graph showing examples of the contents of the humidity table.

The humidity table 28, determining the relation between the relative humidity and a developing bias reduction ratio, is formed by tabling the line graph shown in FIG. 3, for example. In the line graph shown in FIG. 3, the relative humidity is shown on the axis of abscissa, and the developing bias reduction ratio is shown on the axis of ordinate. The line graph is in the form of a straight line passing through a point where the relative humidity is 20% and the developing bias reduction ratio is 0.2 and a point where the relative humidity is 60% and the developing bias reduction ratio is 0.1.

C-2. Sheet Classified Table

FIG. 4 is a diagram showing an example of the sheet classified table.

The sheet classified table 29 determines the relation between a thin sheet, a plain sheet and a thick sheet indicating the types of the sheet P and the developing bias reduction ratio. According to this embodiment, it is assume that a sheet P having weight of not more than 70 g/mm$^2$ per unit area is the thin sheet, a sheet P having weight of 70 to 105 g/mm$^2$ per unit area is the plain sheet, and a sheet P having weight of not less than 105 g/mm$^2$ per unit area is the thick sheet. The sheet classified table 29 shown in FIG. 4 stores 0.1, 0.05 and 0 (zero) as developing bias reduction ratios in association with the thin sheet, the plain sheet and the thick sheet respectively.

C-3. Environment Table

FIG. 5 is a diagram showing an example of the environment table.

The environment table 30 shown in FIG. 5 stores four environment states "a", "b", "c" and "d" in association with combinations of ranges of relative humidity of 0 to 20%, 20 to 40%, 40 to 60% and 80 to 100% and ranges of temperatures of not more than 10° C., 10 to 20° C., 20 to 30° C. and 30 to 40° C. respectively, as described below. The ranges of the relative humidity and the temperatures include the upper limits of these ranges respectively.

In association with a combination of the range of the relative humidity of 0 to 20% and the range of the temperature of not more than 10° C., the environment state "a" is stored.

In association with a combination of the range of the relative humidity of 0 to 20% and the range of the temperature of 10 to 20° C., the environment state "a" is stored.

In association with a combination of the range of the relative humidity of 0 to 20% and the range of the temperature of 20 to 30° C., the environment state "a" is stored.

In association with a combination of the range of the relative humidity of 0 to 20% and the range of the temperature of 30 to 40° C., the environment state "b" is stored.

In association with a combination of the range of the relative humidity of 20 to 40% and the range of the temperature of not more than 10° C., the environment state "b" is stored.

In association with a combination of the range of the relative humidity of 20 to 40% and the range of the temperature of 10 to 20° C., the environment state "b" is stored.

In association with a combination of the range of the relative humidity of 20 to 40% and the range of the temperature of 20 to 30° C., the environment state "b" is stored.

In association with a combination of the range of the relative humidity of 20 to 40% and the range of the temperature of 30 to 40° C., the environment state "c" is stored.

In association with a combination of the range of the relative humidity of 40 to 60% and the range of the temperature of not more than 10° C., the environment state "b" is stored.

In association with a combination of the range of the relative humidity of 40 to 60% and the range of the temperature of 10 to 20° C., the environment state "c" is stored.

In association with a combination of the range of the relative humidity of 40 to 60% and the range of the temperature of 20 to 30° C., the environment state "c" is stored.

In association with a combination of the range of the relative humidity of 40 to 60% and the range of the temperature of 30 to 40° C., the environment state "c" is stored.

In association with a combination of the range of the relative humidity of 60 to 80% and the range of the temperature of not more than 10° C., the environment state "c" is stored.

In association with a combination of the range of the relative humidity of 60 to 80% and the range of the temperature of 10 to 20° C., the environment state "c" is stored.

In association with a combination of the range of the relative humidity of 60 to 80% and the range of the temperature of 20 to 30° C., the environment state "d" is stored.

In association with a combination of the range of the relative humidity of 60 to 80% and the range of the temperature of 30 to 40° C., the environment state "d" is stored.

In association with a combination of the range of the relative humidity of 80 to 100% and the range of the temperature of not more than 10° C., the environment state "d" is stored.

In association with a combination of the range of the relative humidity of 80 to 100% and the range of the temperature of 10 to 20° C., the environment state "d" is stored.

In association with a combination of the range of the relative humidity of 80 to 100% and the range of the temperature of 20 to 30° C., the environment state "d" is stored.

In association with a combination of the range of the relative humidity of 80 to 100% and the range of the temperature of 30 to 40° C., the environment state "d" is stored.

C-4. Selection Table

FIG. 6A is a diagram showing an example of a selection table used in the single-side printing mode. FIG. 6B is a diagram showing an example of a selection table used when the image formed on the second surface of the sheet is a monochromatic image (an image consisting of only a black toner image). FIG. 6C is a diagram showing an example of a selection table used when the image formed on the second surface of the sheet is formed by overlapping toner images of a plurality of colors.

The selection table 31 includes selection tables 31A, 31B and 31C shown in FIGS. 6A, 6B and 6C respectively.

In the selection table 31A shown in FIG. 6A, addresses to be specified in the transfer current table 32 (described later) shown in FIG. 7 are stored in association with combinations of the types of the sheet P and the environment states, as described below.

In association with the thin sheet and the environment state "a", an address "2" is stored.

In association with the thin sheet and the environment state "b", an address "2" is stored.

In association with the thin sheet and the environment state "c", an address "2" is stored.

In association with the thin sheet and the environment state "d", an address "2" is stored.

In association with the plain sheet and the environment state "a", an address "3" is stored.

In association with the plain sheet and the environment state "b", an address "3" is stored.

In association with the plain sheet and the environment state "c", an address "4" is stored.

In association with the plain sheet and the environment state "d", an address "4" is stored.

In association with the thick sheet and the environment state "a", an address "5" is stored.

In association with the thick sheet and the environment state "b", an address "5" is stored.

In association with the thick sheet and the environment state "c", an address "6" is stored.

In association with the thick sheet and the environment state "d", an address "6" is stored.

The selection table 31B shown in FIG. 6B is divided into a region (hereinafter referred to as "first table region") referred to when the image is formed on the first surface P1 of the sheet P and a region (hereinafter referred to as "second table region") referred to when the image is formed on the second surface P2 of the sheet P, and addresses to be specified in the transfer current table 32 (described later) shown in FIG. 7 are stored in the respective regions in association with combinations of the types of the sheet P and the environment states, as described below.

In the first table region, an address "2" is stored in association with the thin sheet and the environment state "a".

In the first table region, and address "2" is stored in association with the thin sheet and the environment state "b".

In the first table region, an address "2" is stored in association with the thin sheet and the environment state "c".

In the first table region, an address "2" is stored in association with the thin sheet and the environment state "d".

In the first table region, an address "3" is stored in association with the plain sheet and the environment state "a".

In the first table region, an address "3" is stored in association with the plain sheet and the environment state "b".

In the first table region, an address "4" is stored in association with the plain sheet and the environment state "c".

In the first table region, an address "4" is stored in association with the plain sheet and the environment state "d".

In the first table region, an address "5" is stored in association with the thick sheet and the environment state "a".

In the first table region, an address "5" is stored in association with the thick sheet and the environment state "b".

In the first table region, an address "6" is stored in association with the thick sheet and the environment state "c".

In the first table region, an address "6" is stored in association with the thick sheet and the environment state "d".

In the second table region, an address "3" is stored in association with the thin sheet and the environment state "a".

In the second table region, an address "3" is stored in association with the thin sheet and the environment state "b".

In the second table region, an address "2" is stored in association with the thin sheet and the environment state "c".

In the second table region, an address "2" is stored in association with the thin sheet and the environment state "d".

In the second table region, an address "4" is stored in association with the plain sheet and the environment state "a".

In the second table region, an address "3" is stored in association with the plain sheet and the environment state "b".

In the second table region, an address "2" is stored in association with the plain sheet and the environment state "c".

In the second table region, an address "2" is stored in association with the plain sheet and the environment state "d".

In the second table region, an address "3" is stored in association with the thick sheet and the environment state "a".

In the second table region, an address "3" is stored in association with the thick sheet and the environment state "b".

In the second table region, an address "4" is stored in association with the thick sheet and the environment state "c".

In the second table region, an address "4" is stored in association with the thick sheet and the environment state "d".

The selection table 31C shown in FIG. 6C is divided into a first table region and a second table region, and addresses to be specified in the transfer current table 32 (described later) shown in FIG. 7 are stored in the respective regions in association with combinations of the types of the sheet P and the environment states, as described below.

In the first table region, an address "1" is stored in association with the thin sheet and the environment state "a".

In the first table region, an address "1" is stored in association with the thin sheet and the environment state "b".

In the first table region, an address "1" is stored in association with the thin sheet and the environment state "c".

In the first table region, an address "1" is stored in association with the thin sheet and the environment state "d".

In the first table region, an address "2" is stored in association with the plain sheet and the environment state "a".

In the first table region, an address "2" is stored in association with the plain sheet and the environment state "b".

In the first table region, an address "3" is stored in association with the plain sheet and the environment state "c".

In the first table region, an address "3" is stored in association with the plain sheet and the environment state "d".

In the first table region, an address "4" is stored in association with the thick sheet and the environment state "a".

In the first table region, an address "4" is stored in association with the thick sheet and the environment state "b".

In the first table region, an address "5" is stored in association with the thick sheet and the environment state "c".

In the first table region, an address "5" is stored in association with the thick sheet and the environment state "d".

In the second table region, an address "3" is stored in association with the thin sheet and the environment state "a".

In the second table region, an address "3" is stored in association with the thin sheet and the environment state "b".

In the second table region, an address "2" is stored in association with the thin sheet and the environment state "c".

In the second table region, an address "2" is stored in association with the thin sheet and the environment state "d".

In the second table region, an address "4" is stored in association with the plain sheet and the environment state "a".

In the second table region, an address "3" is stored in association with the plain sheet and the environment state "b".

In the second table region, an address "2" is stored in association with the plain sheet and the environment state "c".

In the second table region, an address "2" is stored in association with the plain sheet and the environment state "d".

In the second table region, an address "3" is stored in association with the thick sheet and the environment state "a".

In the second table region, an address "3" is stored in association with the thick sheet and the environment state "b".

In the second table region, an address "4" is stored in association with the thick sheet and the environment state "c".

In the second table region, an address "4" is stored in association with the thick sheet and the environment state "c".

C-5. Transfer Current Table

FIG. 7 is a diagram showing an example of the transfer current table.

In the transfer current table 32 shown in FIG. 7, valves of transfer current to be fed to the transfer rollers 13 of the processing sections 3 of black, yellow, magenta and cyan are stored in association with addresses "1", "2", "3", "4", "5" and "6", as described below.

In association with the address "1", 8 μA, 9 μA, 10 μA and 11 μA are stored as transfer current (hereinafter referred to as "K transfer current") to be fed to the transfer roller 13 of the black processing section 3K, transfer current (hereinafter referred to as "Y transfer current") to be fed to the transfer roller 13 of the yellow processing section 3Y, transfer current (hereinafter referred to as "M transfer current") to be fed to the transfer roller 13 of the magenta processing section 3M and transfer current (hereinafter referred to as "C transfer current") to be fed to the transfer roller 13 of the cyan processing section 3C respectively.

In association with the address "2", 9 μA, 10 μA, 11 μA and 12 μA are stored as the K transfer current, the Y transfer current, the M transfer current and the C transfer current respectively.

In association with the address "3", 10 μA, 11 μA, 12 μA and 13 μA are stored as the K transfer current, the Y transfer current, the M transfer current and the C transfer current respectively.

In association with the address "4", 11 μA, 12 μA, 13 μA and 14 μA are stored as the K transfer current, the Y transfer current, the M transfer current and the C transfer current respectively.

In association with the address "5", 12 μA, 13 μA, 14 μA and 15 μA are stored as the K transfer current, the Y transfer current, the M transfer current and the C transfer current respectively.

In association with the address "6", 13 μA, 14 μA, 15 μA and 16 μA are stored as the K transfer current, the Y transfer current, the M transfer current and the C transfer current respectively.

The potential of each transfer roller 13 fluctuates in response to the transfer current fed to the transfer roller 13. Therefore, the feeding of the transfer current to the transfer roller 13 is synonymous with application of the transfer bias to the transfer roller 13. A setup of the transfer current is also synonymous with a setup of the transfer bias. In other words, the transfer bias is indirectly set up when the transfer current is set up in this embodiment, as described later.

D. Developing Bias Setup Processing

Figure 8:
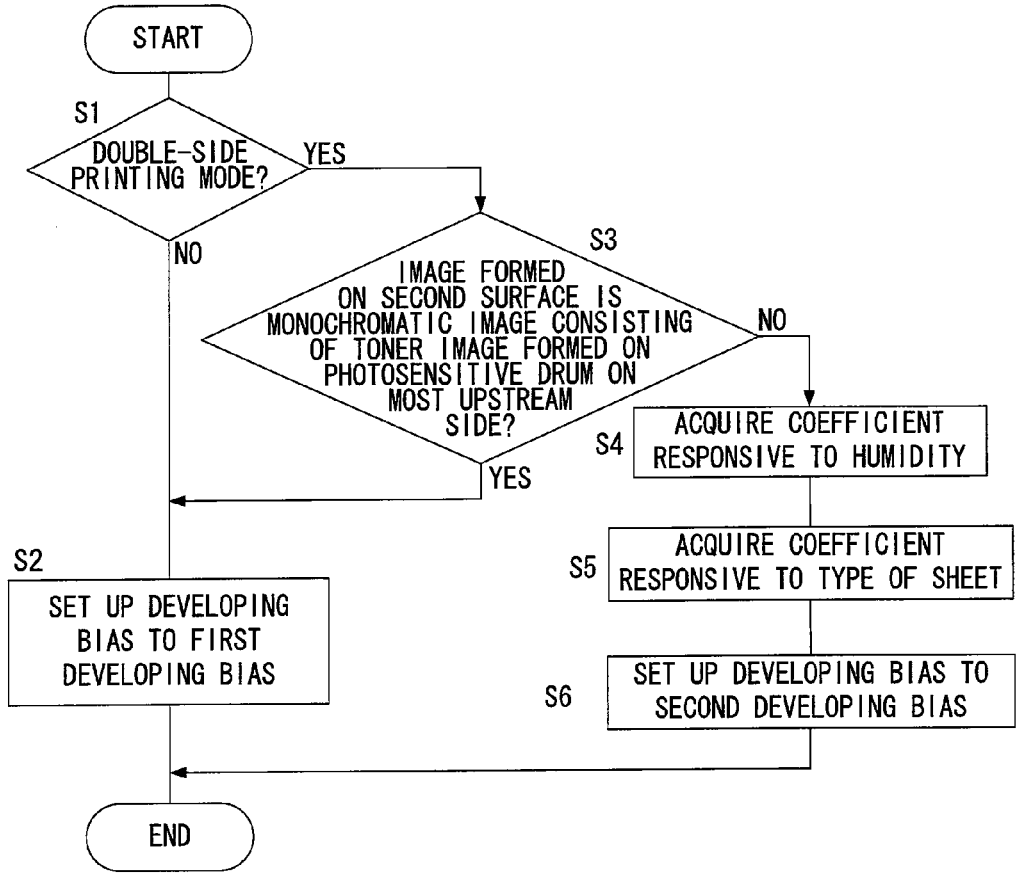
FIG. 8 is a flow chart of developing bias setup processing executed by the microcomputer shown in FIG. 2.

FIG. 8 is a flow chart of developing bias setup processing.

The microcomputer 25 executes the developing bias setup processing, thereby implementing the function of the developing bias set up section 26 and setting up the developing bias to be applied to each developing roller 7.

The color printer 1 is communicatively connected with a personal computer (not shown), for example. When the operation mode of the color printer 1 and the type of the used sheet P are set up on the personal computer and data of the image to be formed on the sheet P are transmitted from the personal computer to the color printer 1 along with the setup contents, the image can be formed on the sheet P in the color printer 1.

When the setup contents on the personal computer and the image data are transmitted to the color printer 1, the microcomputer 25 determines whether or not the operation mode of the color printer 1 is the double-side printing mode (S1).

If the operation mode is not the double-side printing mode (No at S1), i.e., if the operation mode is the single-side printing mode, the developing bias to be applied to each developing roller 7 is set up to a prescribed first developing bias (400 V, for example) (S2). Then, this developing bias setup processing is terminated.

If the operation mode is the double-side printing mode (YES at S1), on the other hand, the microcomputer 25 determines whether or not the image formed on the second surface P2 of the sheet P is a monochromatic image consisting of only a toner image transferred from the photosensitive drum 5 on the most upstream side in the transport direction for the sheet P with the transport belt 10 (hereinafter simply referred to as "most upstream side") (S3). In other words, the microcomputer 25 determines whether or not the image formed on the second surface P2 of the sheet P is a monochromatic image.

If the image formed on the second surface P2 is a monochromatic image (YES at S3), the developing bias to be applied to each developing roller 7 is set up to the first developing bias (S2). Then, this developing bias setup processing is terminated.

If the image formed on the second surface P2 is not a monochromatic image (NO at S3), i.e., if the image formed on the second surface P2 is an image formed by overlapping toner images of a plurality of colors, on the other hand, the humidity table 28 (see FIG. 3) is referred to, and the developing bias reduction ratio responsive to the relative humidity sensed by the humidity sensor 23 is acquired (S4). When the relative humidity sensed by the humidity sensor 23 is 20%, for example, 0.2 is acquired as the developing bias reduction ratio.

When the developing bias reduction ratio responsive to the relative humidity is acquired, the sheet classified table 29 (see FIG. 4) is referred to, and a developing bias reduction ratio responsive to the type of the sheet P is acquired (S5). When the sheet P is a thin sheet, for example, 0.1 is acquired as the developing bias reduction ratio.

The developing bias reduction ratios responsive to the relative humidity and the type of the sheet P are substituted in "A" and "B" of the following equation (1) respectively, and a second developing bias is obtained by solving the following equation (1). The developing bias to be applied to each developing roller 7 is set up to the second developing bias (S6), and this developing bias setup processing is terminated.

$$\text{Second developing bias} = \text{first developing bias} \times (1 - A - B) \quad (1)$$

When the first developing bias is 400 V, the developing bias reduction ratio responsive to the relative humidity is 0.2 and the developing bias reduction ratio responsive to the type of the sheet P is 0.1, for example, 0.2 and 0.1 are substituted in "A" and "B" of the equation (1) respectively and 400×(1−0.2−0.1) is calculated to obtain a result of 280 V, and the second developing bias to be applied to each developing roller 7 is set up to 280 V.

The relative humidity in the main body casing 2 (see FIG. 1) does not reach 100%, and hence the developing bias reduction ratio responsive to the relative humidity does not reach 0 (zero), as obvious from the line graph shown in FIG. 3. Therefore, the second developing bias is lower than the first developing bias.

The equation (1) can be transformed as: second developing bias=first developing bias−first developing bias×A−first developing bias×B. Therefore, the second developing bias is obtained by subtracting the reduction quantity (=first developing bias×A) responsive to the relative humidity sensed by the humidity sensor 23 from the first developing bias and further subtracting the reduction quantity (=first developing bias×B) responsive to the type of the sheet P.

E. Transfer Bias Setup Processing

Figure 9:
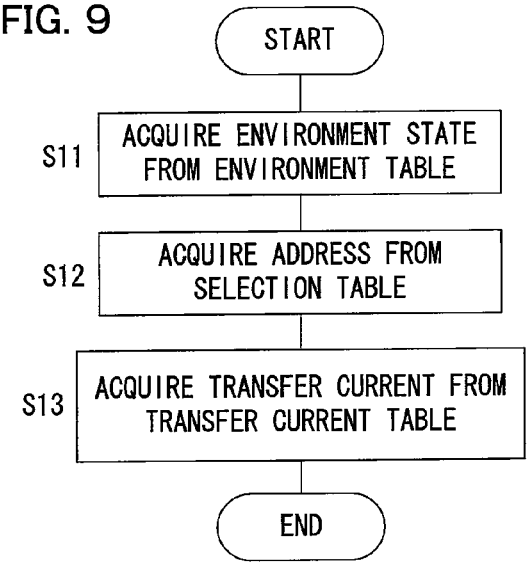
FIG. 9 is a flow chart of transfer bias setup processing executed by the microcomputer shown in FIG. 2.

FIG. 9 is a flow chart of transfer bias setup processing.

The microcomputer 25 executes the transfer bias setup processing, thereby implementing the function of the transfer bias set up section 27 and setting up the transfer bias to be applied to each transfer roller 13.

When the setup contents on the personal computer and the image data are transmitted from the personal computer to the color printer 1 in the transfer bias setup processing, the environment table 30 (see FIG. 5) is first referred to, to determine the environment state responsive to the relative humidity sensed by the humidity sensor 23 and the temperature sensed by the temperature sensor 24 (S11).

When the relative humidity sensed by the humidity sensor 23 is 45% and the temperature sensed by the temperature sensor 24 is 25° C., for example, the environment state is determined as "c".

Then, from the three selection tables 31, that responsive to the operation mode of the color printer 1 and the image formed on the second surface P2 of the sheet P is selected. In other words, the selection table 31A shown in FIG. 6A is selected when the operation mode is the single-side printing mode. When the operation mode is the double-side printing mode and the image formed on the second surface P2 of the sheet P is a monochromatic image, the selection table 31B shown in FIG. 6B is selected. When the operation mode is the double-side printing mode and the image formed on the second surface P2 of the sheet P is an image formed by overlapping toner images of a plurality of colors, the selection table 31C shown in FIG. 6C is selected.

The selected selection table 31 is referred to, and the address responsive to the type of the sheet P and the environment state is acquired (S12). When the selection table 31A or 31B is selected, the addresses responsive to the type of the sheet P and the environment state are acquired from both of the first table region and the second table region.

When the address is acquired from the selection table 31A, the transfer current table 32 shown in FIG. 7 is referred to, and the K transfer current, the Y transfer current, the M transfer current and the C transfer current associated with the address are acquired (S13). In formation of the image on the sheet P, the K transfer current, the Y transfer current, the M transfer current and the C transfer current as acquired are fed to the transfer rollers 13 of the black, yellow, magenta and cyan processing sections 3 respectively.

When addresses are acquired from both of the first table region and the second table region of the selection table 31A or 31B, the transfer current table 32 shown in FIG. 7 is referred to, and the K transfer current, the Y transfer current, the M transfer current and the C transfer current associated with each address are acquired. In formation of the image on the first surface P1 of the sheet P, the K transfer current, the Y transfer current, the M transfer current and the C transfer current as acquired from the first table region in association with the address are fed to the transfer rollers 13 of the black, yellow, magenta and cyan processing sections 3 respectively. In formation of the image on the second surface P2 of the sheet P, the K transfer current, the Y transfer current, the M transfer current and the C transfer current as acquired from the second table region in association with the address are fed to the transfer rollers 13 of the black, yellow, magenta and cyan processing sections 3 respectively.

When the sheet P is a plain sheet and the environment state is determined as "c" in the single-side printing mode, for example, the address "4" is acquired from the selection table 31A shown in FIG. 6A. Then, the K transfer current, the Y transfer current, the M transfer current and the C transfer current are set up to 11 μA, 12 μA, 13 μA and 14 μA respectively according to the transfer current table 32 shown in FIG. 7.

When the image formed on the second surface P2 of the sheet P is a monochromatic image, the sheet P is a plain sheet and the environment state is determined as "c" in the double-side printing mode, for example, the address "4" is acquired from the first table region of the selection table 31B shown in FIG. 6B, and the address "2" is acquired from the second table region of the selection table 31A. Then, the K transfer current, the Y transfer current, the M transfer current and the C transfer current in formation of the image on the first surface P1 of the sheet P are set up to 11 μA, 12 μA, 13 μA and 14 μA respectively according to the transfer current table 32 shown in FIG. 7. Further, the K transfer current, the Y transfer current, the M transfer current and the C transfer current in formation of the image on the second surface P2 of the sheet P are set up to 9 μA, 10 μA, 11 μA and 12 μA respectively.

When the image formed on the second surface P2 of the sheet P is an image formed by overlapping toner images of a plurality of colors, the sheet P is a plain sheet and the environment state is determined as "c" in the double-side printing mode, for example, the address "3" is acquired from the first table region of the selection table 31C shown in FIG. 6C, and the address "2" is acquired from the second table region of the selection table 31C. Then, the K transfer current, the Y transfer current, the M transfer current and the C transfer current in formation of the image on the first surface P1 of the sheet P are set up to 10 μA, 11 μA, 12 μA and 13 μA respectively according to the transfer current table 32 shown in FIG. 7. Further, the K transfer current, the Y transfer current, the M transfer current and the C transfer current in formation of the image on the second surface P2 of the sheet P are set up to 9 μA, 10 μA, 11 μA and 12 μA respectively.

As obvious from the transfer current table 32 shown in FIG. 7, the K transfer current, the Y transfer current, the M transfer current and the C transfer current are so set up that the C transfer current fed to the transfer roller 13 of the processing section 3C on the most downstream side in the transport direction for the sheet P with the transport belt 10 (hereinafter simply referred to as "most downstream side") is greater than the K transfer current, the Y transfer current and the M transfer current regardless of the operation mode of the color printer 1 etc.

F. Effects

As hereinabove described, the color printer 1 has the single-side printing mode of forming an image on the single surface of the sheet P and the double-side printing mode of forming an image on the first surface P1 of the sheet P and thereafter forming another image on the second surface P2 of the sheet P opposite to the first surface P1. Further, the color printer 1 includes the photosensitive drums 5 corresponding to black, yellow, magenta and cyan respectively. The photosensitive drums 5 are arranged in line in the transport direction for the sheet P with the transport belt 10. The developing roller 7 for developing the electrostatic latent image formed on each photosensitive drum 5 into the toner image and the transfer roller 13 for transferring the toner image from the photosensitive drum 5 to the sheet P are provided correspondingly to each photosensitive drum 5. The developing bias and the transfer bias are applied to each developing roller 7 and each transfer roller 13 respectively.

The transfer current fed to each transfer roller 13 is so set up that the transfer bias applied to the transfer roller 13 on the most downstream side is greater than those applied to the remaining transfer rollers 13. In other words, the transfer current fed to each transfer roller 13 is so set up that the transfer bias applied to the transfer roller 13 arranged on the most downstream side has the greatest value among all transfer rollers 13. Thus, reduction in transfer efficiency of the toner from the photosensitive drum 5 on the most downstream side to the sheet P can be suppressed, and the toner image can be excellently transferred from the photosensitive drum 5 on the most downstream side to the sheet P.

In the single-side printing mode, the developing bias applied to each developing roller 7 is set up to the first developing bias. The first developing bias has a value for feeding a proper quantity of toner from the developing roller 7 to the photosensitive drum 5, for example. Thus, the proper quantity of toner is fed from each developing roller 7 to each photosensitive drum 5, whereby the electrostatic latent image formed on each photosensitive drum 5 can be excellently developed.

In the double-side printing mode, the sheet P is heated for fixing the toner image when the image is formed on the first surface P1 of the sheet P, and the sheet P is dried by this heating. When the image is formed on the second surface P2 of the sheet P, therefore, the surface potential of the sheet P is remarkably increased due to the toner charged up on the sheet P.

When the image formed on the second surface P2 of the sheet P is an image formed by overlapping toner images of a plurality of colors in the double-side printing mode, therefore, the developing bias applied to each developing roller 7 in formation of the image on the first surface P1 and in formation of the image on the second surface P2 is set up to the second developing bias lower than the first developing bias. Thus, the quantity of the toner fed from each developing roller 7 to each photosensitive drum 5 can be reduced, and the quantity of the toner transferred from each photosensitive drum 5 to the sheet P can be reduced as a result. The charging quantity of the toner on the overall sheet P can be reduced by reducing the quantity of the toner fed to the sheet P, whereby increase in the surface potential of the sheet P can be suppressed. Consequently, the potential difference between the transfer roller 13 and the sheet P can be reduced, and discharge between the transfer roller 13 and the sheet P can be prevented even if the transfer bias applied to the transfer roller 13 on the most downstream side is set up to a relatively large level.

Therefore, the toner image can be excellently transferred from the photosensitive drum 5 to the sheet P while preventing discharge between the transfer roller 13 and the sheet P.

When the image formed on the second surface P2 of the sheet P is an image formed by overlapping toner images of a plurality of colors in the double-side printing mode, the developing bias applied to each developing roller 7 is set up to the second developing bias not only in formation of the image on the second surface P2 but also in formation of the image on the first surface P1. In formation of the image on the first surface P1 and formation of the image on the second surface P2, therefore, the quantities of the toner fed from the developing roller 7 to the photosensitive drum 5 can be generally matched with each other. Consequently, images of generally identical concentrations can be formed on the first surface P1 and the second surface P2 of the sheet P.

The color printer 1 includes the humidity sensor 23 sensing the humidity. The second developing bias is obtained by subtracting the reduction quantity responsive to the humidity sensed by the humidity sensor 23 and the reduction quantity responsive to the type (thickness) of the sheet P from the first developing bias. When the image formed on the second surface P2 of the sheet P is an image formed by overlapping toner images of a plurality colors in the double-side printing mode, the developing bias applied to each developing roller 7 is set up to the value obtained by subtracting the reduction quantities from the first developing bias.

As the humidity sensed by the humidity sensor 23 is increased, the reduction quantity (the developing bias reduction ratio) of the second developing bias with respect to the first developing bias is reduced. In other words, the reduction quantity of the second developing bias with respect to the first developing bias is set up to a larger value, the value of the second developing bias is reduced, and the developing bias applied to each developing roller 7 is reduced as the humidity sensed by the humidity sensor 23 is reduced. Thus, the quantity of the toner fed from each developing roller 7 to each photosensitive drum 5 can be reduced as the humidity sensed by the humidity sensor 23 is reduced, and the quantity of the toner transferred from each photosensitive drum 5 to the sheet P can be reduced as a result.

The moisture content in the sheet P is reduced as the humidity in the main body casing 2 is reduced, and hence the sheet P exhibits relatively high electrical resistance and the surface potential of the sheet P is remarkably increased due to the toner charged up on the sheet P. Therefore, the quantity of the toner transferred from each photosensitive drum 5 to the sheet P is reduced as the humidity sensed by the humidity sensor 23 is reduced. Thus, increase in the surface potential of the sheet P is suppressed, whereby the potential difference between the transfer roller 13 and the sheet P can be reduced, and discharge between the transfer roller 13 and the sheet P can be excellently prevented.

When the sheet P is a thin sheet, the developing bias reduction ratio is set up to 0.1 as an example of a first value, as shown in FIG. 4. The developing bias reduction ratio is set up to 0.05 as an example of a second value when the sheet P is a plain sheet, while the developing bias reduction ratio is set up to 0 (zero) as an example of a third value when the sheet P is a thick sheet.

The electrical resistance of a plain sheet is remarkably increased following drying resulting from the heating for fixing the toner image as compared with a thick sheet. When the sheet P is a plain sheet, therefore, the surface potential of the sheet P is remarkably increased due to the toner charged up on the sheet P as compared with the case where the sheet P is a thick sheet. When a plain sheet is used as the sheet P, therefore, the developing bias reduction ratio is set up to a greater value (the second developing bias is reduced) as compared with the case where a thick sheet is used as the sheet P, and the developing bias applied to each developing roller 7 is reduced. Thus, increase in the surface potential of the sheet P is suppressed.

The electrical resistance of a thin sheet is remarkably increased following drying resulting from the heating for fixing the toner image as compared with a plain sheet. When the sheet P is a thin sheet, therefore, the surface potential of the sheet P is remarkably increased due to the toner charged up on the sheet as compared with the case where the sheet P is a plain sheet. When a thin sheet is used as the sheet P, therefore, the developing bias reduction ratio is set up to a greater value (the second developing bias is reduced) as compared with the case where a plain sheet is used as the sheet P, and the developing bias applied to each developing roller 7 is reduced. Thus, increase in the surface potential of the sheet P is suppressed.

Therefore, the potential difference between the transfer roller 13 and the sheet P can be suppressed and discharge between the transfer roller 13 and the sheet P can be excellently prevented whether the sheet P is a thin sheet, a plain sheet or a thick sheet.

When the image formed on the second surface P2 of the sheet P is a monochromatic image consisting of only a toner image transferred from the photosensitive drum 5 on the most upstream side in the double-side printing mode, both of the developing biases applied to each developing roller 7 in formation of the image on the first surface P1 and in formation of the image on the second surface P2 are set up to the first developing bias. In this case, no toner images are formed on the photosensitive drums 5 other than the photosensitive drum 5 on the most upstream side in formation of the image on the second surface P2 of the sheet P, whereby the surface potential of the sheet P is not much increased. Therefore, no discharge takes place between the transfer roller 13 and the sheet P even if the developing bias is set up to the first developing bias.

F. Modifications

The present invention may be embodied in other ways.

While the black, yellow, magenta and cyan processing sections 3 are arranged in this order in the transport direction for the sheet P with the transport belt 10, the order of arrangement of the processing sections 3 can arbitrarily be decided.

For example, the cyan processing section 3 may be arranged on the most upstream side. According to this structure, the developing biases applied to each developing roller 7 in formation of the image on the first surface P1 and in formation of the image on the second surface P2 are set up to the first developing bias when the image formed on the second surface P2 of the sheet P is a monochromatic image consisting of only a cyan toner image in the double-side printing mode. Even if the image formed on the second surface P2 of the sheet P is a monochromatic image in the double-side printing mode, the developing biases applied to each developing roller 7 in formation of the image on the first surface P1 and in formation of the image on the second surface P2 are set up not to the first developing bias but to the second developing bias lower than the first developing bias.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus having a single-side printing mode of forming an image on a single surface of a recording medium and a double-side printing mode of forming an image on a first surface of the recording medium and thereafter forming another image on a second surface of the recording medium opposite to the first surface, comprising:

a plurality of photosensitive members arranged in line in a transport direction for the recording medium so that electrostatic latent images are formed thereon;

a plurality of developing members, each developing member corresponding to a photosensitive member of the plurality of photosensitive members, and each developing member being supplied with a developing bias for forming a first potential difference between the developing member and the corresponding photosensitive member, for feeding a developer of a prescribed color to the corresponding photosensitive member and developing the electrostatic latent image formed on the corresponding photosensitive member into a developer image;

a plurality of transfer members, each transfer member corresponding to a photosensitive member of the plurality of photosensitive members, and each transfer member being supplied with a transfer bias for forming a second potential difference between the transfer member and the corresponding photosensitive member, for transferring the developer image on the corresponding photosensitive member to the recording medium;

a transfer bias set up section setting up the transfer bias applied to each transfer member so that the transfer bias applied to the transfer member corresponding to the photosensitive member on the most downstream side in the transport direction is greater than the transfer bias applied to the one or more other transfer members; and a developing bias set up section setting up the developing bias applied to each developing member to a first developing bias in the single-side printing mode while setting up the developing bias applied to each developing member in formation of the image on the first surface and in formation of the image on the second surface to a second developing bias lower than the first developing bias when the image formed on the second surface is an image formed by overlapping developer images of a plurality of colors in the double-side printing mode.

2. The image forming apparatus according to claim 1, further comprising a humidity sensor sensing humidity, wherein the second developing bias is a value obtained by subtracting a reduction quantity responsive to the humidity sensed by the humidity sensor from the first developing bias.

3. The image forming apparatus according to claim 2, wherein the developing bias set up section sets up the reduction quantity to a smaller value as the humidity sensed by the humidity sensor is increased.

4. The image forming apparatus according to claim 3, wherein the second developing bias is further obtained by subtracting a reduction value responsive to a thickness of the recording medium from the first developing bias.

5. The image forming apparatus according to claim 4, wherein the developing bias set up section sets up the reduction quantity to a first value when a weight of the recording medium per unit area is not more than a first weight, sets up the reduction quantity to a second value smaller than the first value when the weight of the recording medium per unit area is greater than the first weight and less than a second weight, and sets up the reduction quantity to a third value smaller than the second value when the weight of the recording medium per unit area is not less than the second weight.

6. The image forming apparatus according to claim 5, wherein the developing bias set up section sets up the developing bias applied to each developing member in formation of the image on the first surface and in formation of the image on the second surface to the first developing bias when the image formed on the second surface is a monochromatic image consisting of only the developer image transferred from the photosensitive member on the most upstream side in the transport direction in the double-side printing mode.

7. The image forming apparatus according to claim 1, wherein the second developing bias is a value obtained by subtracting a reduction value responsive to a thickness of the recording medium from the first developing bias.

8. The image forming apparatus according to claim 7, wherein the developing bias set up section sets up the reduction quantity to a first value when a weight of the recording medium per unit area is not more than a first weight, sets up the reduction quantity to a second value smaller than the first value when the weight of the recording medium per unit area is greater than the first weight and less than a second weight, and sets up the reduction quantity to a third value smaller than the second value when the weight of the recording medium per unit area is not less than the second weight.

9. The image forming apparatus according to claim 1, wherein the developing bias set up section sets up the developing bias applied to each developing member in formation of the image on the first surface and in formation of the image on the second surface to the first developing bias when the image formed on the second surface is a monochromatic image consisting of only the developer image transferred from the photosensitive member on the most upstream side in the transport direction in the double-side printing mode.

10. An image forming apparatus having a single-side printing mode of forming an image on a single surface of a recording medium and a double-side printing mode of forming an image on a first surface of the recording medium and thereafter forming another image on a second surface of the recording medium opposite to the first surface, comprising:

a plurality of photosensitive members arranged in line in a transport direction for the recording medium so that electrostatic latent images are formed thereon;

a plurality of developing members, each developing member corresponding to a photosensitive member of the plurality of photosensitive members, and each developing member being supplied with a developing bias for forming a first potential difference between the developing member and the corresponding photosensitive member, for feeding a developer of a prescribed color to the corresponding photosensitive member and developing the electrostatic latent image formed on the corresponding photosensitive member into a developer image;

a plurality of transfer members, each transfer member corresponding to a photosensitive member of the plurality of photosensitive members, and each transfer member being supplied with a transfer bias for forming a second potential difference between the transfer member and the corresponding photosensitive member, for transferring the developer image on the corresponding photosensitive member to the recording medium;

a processor; and memory storing computer-readable instructions that, when executed, cause the processor to provide:

a transfer bias set up section setting up the transfer bias applied to each transfer member so that the transfer bias applied to the transfer member corresponding to the photosensitive member on the most downstream side in the transport direction is greater than the transfer bias applied to the one or more other transfer members; and a developing bias set up section setting up the developing bias applied to each developing member to a first developing bias in the single-side printing mode while setting up the developing bias applied to each developing member in formation of the image on the first surface and in formation of the image on the second surface to a second developing bias lower than the first developing bias when the image formed on the second surface is an image formed by overlapping developer images of a plurality of colors in the double-side printing mode.

11. The image forming apparatus according to claim 10, further comprising a humidity sensor sensing humidity, wherein the second developing bias is a value obtained by subtracting a reduction quantity responsive to the humidity sensed by the humidity sensor from the first developing bias.

12. The image forming apparatus according to claim 11, wherein the developing bias set up section sets up the reduction quantity to a smaller value as the humidity sensed by the humidity sensor is increased.

13. The image forming apparatus according to claim 12, wherein the second developing bias is further obtained by subtracting a reduction value responsive to a thickness of the recording medium from the first developing bias.

14. The image forming apparatus according to claim 13, wherein the developing bias set up section sets up the reduction quantity to a first value when a weight of the recording medium per unit area is not more than a first weight, sets up the reduction quantity to a second value smaller than the first value when the weight of the recording medium per unit area is greater than the first weight and less than a second weight, and sets up the reduction quantity to a third value smaller than the second value when the weight of the recording medium per unit area is not less than the second weight.

15. The image forming apparatus according to claim 14, wherein the developing bias set up section sets up the developing bias applied to each developing member in formation of the image on the first surface and in formation of the image on the second surface to the first developing bias when the image formed on the second surface is a monochromatic image consisting of only the developer image transferred from the photosensitive member on the most upstream side in the transport direction in the double-side printing mode.

16. The image forming apparatus according to claim 10, wherein the second developing bias is a value obtained by subtracting a reduction value responsive to a thickness of the recording medium from the first developing bias.

17. The image forming apparatus according to claim 16, wherein the developing bias set up section sets up the reduction quantity to a first value when a weight of the recording medium per unit area is not more than a first weight, sets up the reduction quantity to a second value smaller than the first value when the weight of the recording medium per unit area is greater than the first weight and less than a second weight, and sets up the reduction quantity to a third value smaller than the second value when the weight of the recording medium per unit area is not less than the second weight.

18. The image forming apparatus according to claim 10, wherein the developing bias set up section sets up the developing bias applied to each developing member in formation of the image on the first surface and in formation of the image on the second surface to the first developing bias when the image formed on the second surface is a monochromatic image consisting of only the developer image transferred from the photosensitive member on the most upstream side in the transport direction in the double-side printing mode.

* * * * *